US009387496B2

(12) United States Patent
Kah, III

(10) Patent No.: US 9,387,496 B2
(45) **Date of Patent: *Jul. 12, 2016**

(54) APPARATUS FOR MAINTAINING CONSTANT SPEED IN A VISCOUS DAMPED ROTARY NOZZLE SPRINKLER

(71) Applicant: Carl L. C. Kah, III, North Palm Beach, FL (US)

(72) Inventor: Carl L. C. Kah, III, North Palm Beach, FL (US)

( * ) Notice: Subject to any disclaimer, the term of this patent is extended or adjusted under 35 U.S.C. 154(b) by 382 days.

This patent is subject to a terminal disclaimer.

(21) Appl. No.: 13/662,536

(22) Filed: Oct. 28, 2012

(65) Prior Publication Data

US 2013/0105596 A1 May 2, 2013

Related U.S. Application Data

(60) Provisional application No. 61/552,153, filed on Oct. 27, 2011.

(51) Int. Cl.

| | |
|---|---|
| ***B05B 3/06*** | (2006.01) |
| ***B05B 3/02*** | (2006.01) |
| ***B05B 3/00*** | (2006.01) |
| ***B05B 3/04*** | (2006.01) |

(52) U.S. Cl.

CPC ..... *B05B 3/063* (2013.01); *B05B 3/005* (2013.01); *B05B 3/02* (2013.01); *B05B 3/021* (2013.01); *B05B 3/0486* (2013.01)

(58) Field of Classification Search

CPC ..... B05B 3/049; B05B 3/003; B05B 3/0486; B05B 15/10; B05B 3/005; B05B 3/063; B05B 3/1021; B05B 3/1085; B05B 3/02; B05B 3/021

USPC ..... 239/252, 222.15, 222.11, 222.19, 230, 239/505, 507, 510–513, 333

See application file for complete search history.

(56) References Cited

U.S. PATENT DOCUMENTS

| | | | | |
|---|---|---|---|---|
| 4,754,925 | A * | 7/1988 | Rubinstein | 239/230 |
| 4,944,456 | A * | 7/1990 | Zakai | 239/222.19 |
| 4,967,961 | A * | 11/1990 | Hunter | 239/240 |
| 5,718,381 | A * | 2/1998 | Katzer et al. | 239/222.11 |

* cited by examiner

*Primary Examiner* — Len Tran
*Assistant Examiner* — Cody Lieuwen
(74) *Attorney, Agent, or Firm* — Ostrolenk Faber LLP

(57) ABSTRACT

A rotating deflector for use with a rotary sprinkler in accordance with an embodiment of the present disclosure includes a conical body, a plurality of channels formed on a bottom surface of the conical body and extending from a center of the conical body outward toward an outer edge of the conical body, and a deflector ring rotatably mounted on the conical body such that the deflector ring rotates from a first position in which the deflector ring provides additional rotational force for rotation of the deflector and a second position in which the deflector ring provides substantially no rotational force for rotation of the deflector.

16 Claims, 4 Drawing Sheets

APPARATUS FOR MAINTAINING CONSTANT SPEED IN A VISCOUS DAMPED ROTARY NOZZLE SPRINKLER

CROSS-REFERENCE TO RELATED APPLICATIONS

The present application claims benefit of and priority to U.S. Provisional Patent Application Ser. No. 61/552,153 filed Oct. 27, 2011 entitled VISCOUS DAMPED ROTARY NOZZLE SPEED CONTROL, the entire content of which is hereby incorporated by reference herein.

BACKGROUND

1. Field of the Disclosure

The present disclosure relates to an apparatus and method for maintaining consistent rotational speed of a rotary nozzle sprinkler with viscous damping when the arc of coverage is adjusted resulting in varying water flow rates.

2. Related Art

Rotary sprinklers using viscous dampening have been in use in the irrigation industry for more than fifteen years. Viscous damping resistance is provided to apply a specific amount of friction to counter movement of a deflector of the rotary sprinkler when a force is applied to it. Viscous damping has several advantages over gear driven sprinklers or impact sprinklers. For example, viscous damped sprinklers have fewer moving parts and a longer life. One drawback of viscous damped sprinklers is the inability to control the speed of rotation over varying water flow and pressure ranges.

Today, in the sprinkler industry, there are several manufacturers of rotary nozzles. These rotary nozzles use viscous damping, which is known in the art, to limit the speed at which the sprinklers rotate. Viscous damping relies upon oils or greases to create friction to limit sprinkler rotation speeds. Viscous damped units, however, typically are unable to maintain a consistent rotational speed over a wide range of pressure and flow rates. Another problem may arise when a small arc of coverage is selected, where the viscous damped sprinkler will have a very low flow rate. The low flow rate may not provide enough kick, or rotational force, to rotate the deflector and the rotary nozzle will stop rotating or stall.

Water deflection at the discharge point is what typically determines the power and rotational speed. Viscous damped rotary nozzles utilize a deflector with multiple fixed angular slots, or channels, which discharge the water off the deflector in streams. As the water is discharged from the internal valve it strikes the deflector and force is exerted on the deflector supplying the power to rotate the deflector while the viscous oil limits the speed of the turning deflector. The limitation of the current designs on the market is that as the arc of coverage increased, the flow against the deflector increases to maintain matched precipitation. This results in an increase in the rotational speed of the deflector because there are more streams of water and more force exerted on the deflector. Currently, in the industry, contractors and consumers have to purchase rotary nozzles in fixed patterns 90, 180, 270, and 360 degrees or nozzles that have limited adjustable range. These units in order to maintain speed over different flow rates all have unique deflectors to compensate for the amount of water to control the speed. The limitation with these conventional units that are currently on the market is that if the flow or pressure is changed, the rotation speed of the sprinkler increases or decreases. That is, there is no mechanism to change or control the rotational speed. A few manufacturers offer adjustable units that are adjustable only through a limited range, not 80 to 360 degrees.

Accordingly, it would be desirable to provide a deflector of a rotary sprinkler that avoids these and other problems.

SUMMARY

An objective of the present disclosure is to provide a means for increasing or decreasing the speed of rotation of a rotary nozzle sprinkler.

Another objective is to expand the operating pressure range of rotary nozzle sprinklers.

A rotating deflector for use with a rotary sprinkler in accordance with an embodiment of the present disclosure includes a conical body, a plurality of channels formed on a bottom surface of the conical body and extending from a center of the conical body outward toward an outer edge of the conical body, and a deflector ring rotatably mounted on the conical body such that the deflector ring rotates from a first position in which the deflector ring provides additional rotational force for rotation of the deflector and a second position in which the deflector ring provides substantially no rotational force for rotation of the deflector.

A rotary sprinkler assembly in accordance with an embodiment of the present disclosure includes a base configured to received water, a riser mounted in the base and movable from a down position to an up position in the base, and a rotary nozzle assembly provided at a top of the riser and configured to direct water that flows through the base and the riser outward around the rotary sprinkler assembly. The rotary nozzle assembly included a rotating deflector configured to deflect the water outward around the rotary sprinkler assembly. The rotating deflector includes a conical body, a plurality of channels formed on a bottom surface of the conical body and extending from a center of the conical body outward toward an outer edge of the conical body to direct water outward around the rotary sprinkler assembly, and a deflector ring rotatably mounted on the conical body such that the deflector ring rotates from a first position in which the deflector ring provides additional rotational force for rotation of the deflector and a second position in which the deflector ring provides substantially no rotational force for rotation of the deflector.

Other features and advantages of the present invention will become apparent from the following description of the invention which refers to the accompanying drawings.

DETAILED DESCRIPTION OF EMBODIMENTS OF THE INVENTION

The present disclosure provides a simple apparatus for maintaining consistent rotational speed of a rotary nozzle sprinkler with viscous damping when the arc of coverage is adjusted resulting in varying water flow rates. A benefit of this new design is that one adjustable arc rotary nozzle sprinkler can be used in the place of several different fixed arc units. The adjustable unit still maintains speed and uniformity across adjustment from 80 to 360 degrees. Rotation speed is important to maintaining uniform distribution and distance of throw. With the disclosed enhancement to an adjustable arc rotary sprinkler, one unit can replace what now takes three separate units to cover area from 80 to 360 degrees.

The present disclosure is related to controlling the rotational speed of viscous damped units over a wide operating flow range. Today in the industry, to deal with the speed control issues, most manufacturers build viscous damped sprinklers in fixed arcs of coverage changing the amount of water deflection to control the speed of the units.

This present disclosure specifically shows how a small ring 1 is added to the deflector which may be used to increase or decrease the amount of kick provided by water flow in a limited number of discharge streams of the deflector to increase the angular discharge for small arcs of coverage to have reliable rotation speeds.

Figure 1:
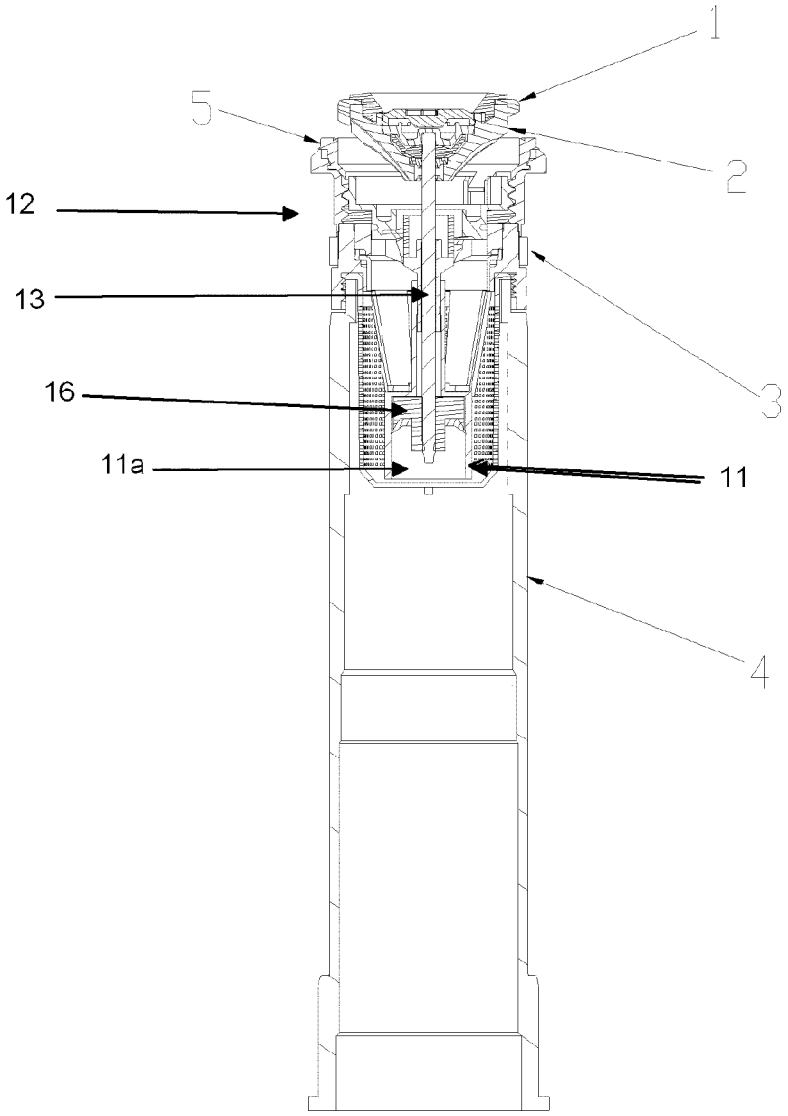
FIG. 1 shows a cross sectional view of a riser of a pop-up sprinkler with a rotary nozzle assembly installed in accordance with an embodiment of the present disclosure.

More specifically, FIG. 1 illustrates a cross sectional view of a riser 4 for use in a rotary sprinkler assembly 101. The riser 4 is similar to that utilized in any conventional pop-up type sprinkler. The riser 4 is preferably biased in a down position via a biasing element such as a spring and extends upward into an up position by water pressure acting thereon. Water is provided from a water supply that is typically connected at an inlet provided below the riser 4. The riser 4 may be mounted in a sprinkler base of a rotary sprinkler assembly just as in any pop-up sprinkler assembly. The riser 4 is mounted in the base such that it is movable between a down or lowered position and a raised, or up position when operating.

A rotary nozzle assembly 12 is mounted on the top of the riser 4. The rotary nozzle assembly 12 of FIG. 1 preferably allows for adjustment of arc of coverage via arc adjustment ring 5 and flow control via flow control ring 3. That is, the nozzle assembly 12 allows for adjustments to both the arc of coverage and the flow rate of water to the deflector 2. Examples of rotary sprinklers that include arc of coverage control and flow control may be found in U.S. patent application Ser. No. 11/947,571 filed Nov. 29, 2007 entitled Sprinkler Head Nozzle Assembly with Adjustable Arc Flow Rate and Stream Angle which claims priority to U.S. Provisional Patent Application Ser. No. 60/912,836 filed Apr. 19, 2007 entitled Adjustable Arc Flow Rate and Stream Angle Viscous Damped Rotary Low Flow Rate Fully Adjustable Sprinkler Nozzles and U.S. patent application Ser. No. 12/348,864, filed Jan. 5, 2009 entitled Arc And Ranged Of Coverage Adjustable Stream Rotor Sprinkler which claims priority to U.S. Provisional Patent Application Ser. No. 61/018,833 filed Jan. 3, 2008 entitled Arc and Range of Coverage Adjustable Stream Rotor Sprinkler, the entire content of each of which is hereby incorporated by reference herein.

In a preferred embodiment, the rotary nozzle assembly 12 includes a deflector 2 mounted on a shaft 13 that extends downward to a viscous braking assembly 11. The bottom end of the shaft 13 includes or is connected to a rotor 16. The bottom end of the shaft 13 and the rotor 16 are mounted in a fluid chamber 11 a of the end of the shaft 13. The fluid chamber 11*a* includes a viscous material such as oil or grease. The rotor 16 is sized such that there is a narrow clearance between the outer edge of the rotor and the inner surface of the sidewall of the chamber 11*a*. The deflector 2 is secured to the shaft 13 such that the shaft rotates with the deflector. The resistance of the viscous fluid in the chamber 11*a* against the rotation of rotor 16 limits the speed of rotation of the deflector 2.

Figure 2:
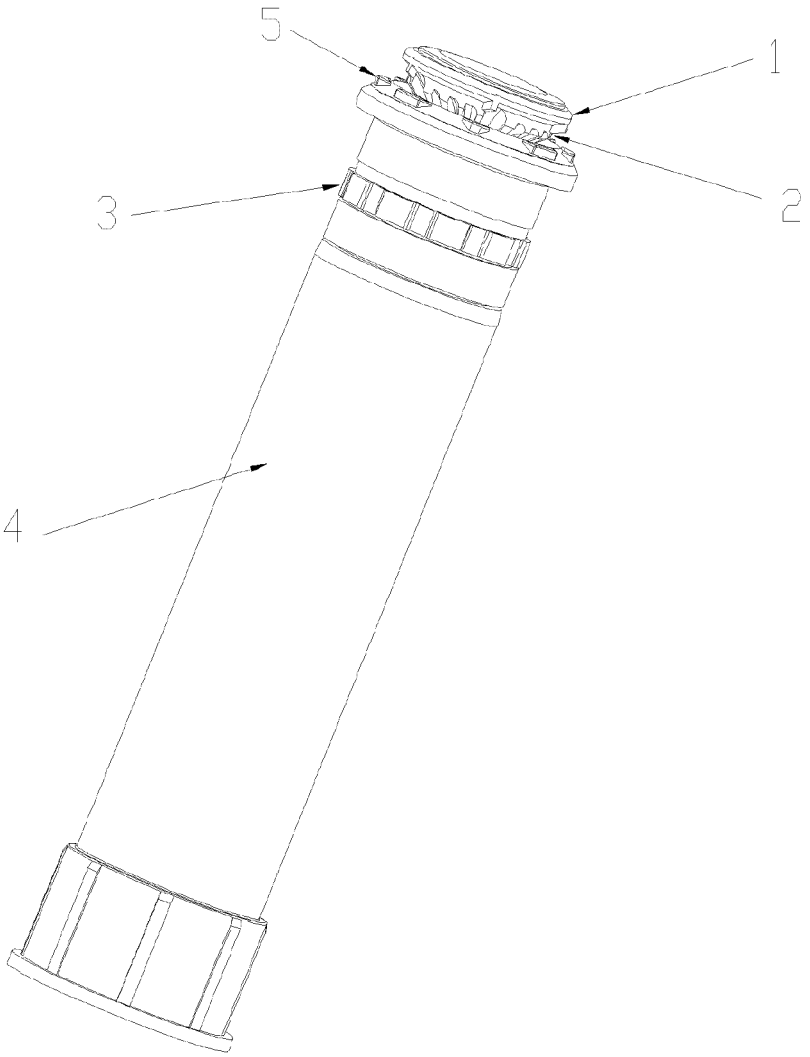
FIG. 2 shows a side view of the riser of FIG. 1.

The flow control ring 3 shown in FIGS. 1 and 2 is used to increase or decrease water flow to the deflector 2 and the distance over which water is deflected away from the deflector 2. An arc adjustment ring 5, also shown in FIGS. 1 and 2, increases or decreased the arc of coverage. Specifically, the ring 5 is rotated to open and close an arcuate opening through which water passes and then strikes the deflector 2.

Figure 3:
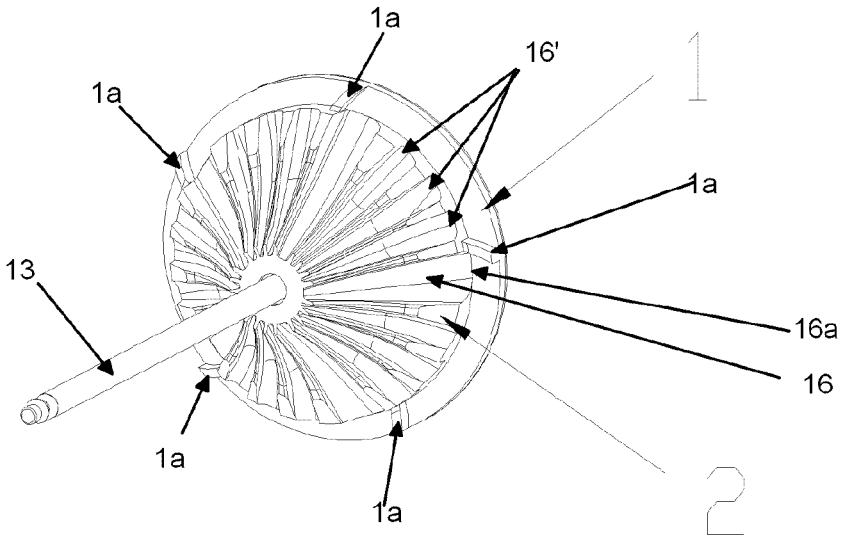
FIG. 3 shows a bottom view of a rotary nozzle deflector of the rotary nozzle assembly including a stream deflector ring positioned such that the water stream will impinge on the stream deflector ring in accordance with an embodiment of the present disclosure.

The deflector 2 further includes a stream deflector ring 1. In FIG. 1, the deflector 2 is in the up, operating position. FIG. 2 shows the deflector 2 in the operating position as well. FIG. 3 shows a bottom view of the deflector 2 with the flow slots or channels 16, 16' through which water is directed to the outside of the deflector 2. The deflector 2 is preferably substantially cone shaped with the channels 16, 16' formed on a bottom surface of the conically shaped deflector and extending from a center and outward to the outer edge thereof. Water flows upward from the bottom of the riser 4, through the arcuate opening controlled by the ring 5 and contact the deflector 2 where it enters the channels 16, 16' near a center of the deflector and is guided outward by the channels to be distributed outward around the sprinkler assembly 101.

Figure 4:
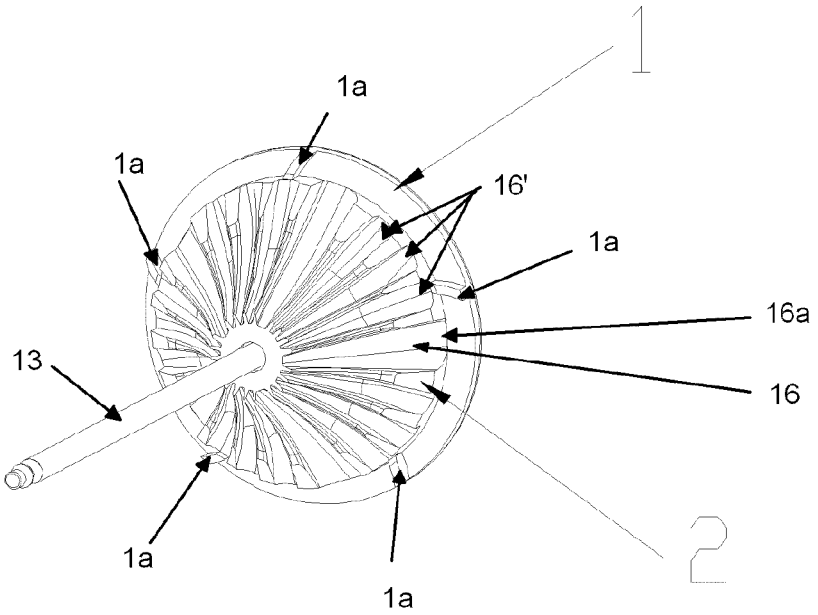
FIG. 4 shows a bottom view of a rotary nozzle deflector of the rotary nozzle assembly with the stream deflector ring positioned to not impinge on the water stream in accordance with an embodiment of the present disclosure.

The deflector ring 1 includes a plurality of downward extending ribs 1*a* that extend at an angle to the radial direction. That is, the ribs 1*a* extend outward away from the center of the deflector 2 at an angle to a radius of the deflector 2. Alternatively, the ribs 1*a* may simply be curved relative to a radius of the deflector 2. The ring 1 is rotatable with respect to the deflector 2 and the channels 16, 16' formed therein, such that the ribs 1*a* may be moved between a first position and a second position. In the first position, illustrated in FIG. 3, for example, the ribs 1*a* are positioned such they extend into the outlets 16*a* of as least some of the channels 16 of the deflector 2. As a result, the water flowing out of these channels 16 imparts additional rotational force on the deflector 2 via the angled ribs 1*a*. In FIG. 4, the ring 1 has been rotated such that the ribs 1*a* are in the second position, wherein the ribs are moved away from the outlets 16*a* of the channels 16. In the second position, the ribs 1*a* do not provide any additional rotational force to the deflector 2.

In use, when the arc of coverage is relatively small and/or when the flow rate is reduced, the ring 1 is rotated to place the ribs 1*a* in the first position such that they impart additional rotational force to the deflector 2 to maintain relatively constant speed despite the reduced flow and contact of the water with the deflector 2. At higher flow rates and/or arcs of coverage, the ring 1 is rotated to move the ribs 1*a* into the second position since additional rotational force is unnecessary to maintain speed.

While five ribs 1*a* are illustrated in FIGS. 3 and 4, the ring 1 may include additional ribs, or fewer ribs, as desired. In the embodiment of FIGS. 3-4, the ribs 1*a* are positioned to move into and out of alignment with select channels 16 that are generally somewhat larger than other channels 16' of the deflector 2. While this is a preferred embodiment, the ribs 1*a* may be used in conjunction with any of the channels, 16, 16', if desired.

Although the present invention has been described in relation to particular embodiments thereof, many other variations and modifications and other uses will become apparent to those skilled in the art.

What is claimed is:

1. A rotating deflector for use in a rotary sprinkler comprises:

a plurality of channels formed on a bottom surface of the rotating deflector and extending from a center of the rotating deflector outward toward an outer edge of the rotating deflector; and a deflector ring rotatably mounted on the rotating deflector such that the deflector ring's rotational position relative to the rotating deflector is settable manually to provide a desired rotation speed of the rotating deflector between a first position in which the deflector ring provides additional rotational force for rotation of the deflector and a second position in which the deflector ring provides substantially no additional rotational force for rotation of the deflector, the deflector ring mounted on the rotating deflector such that the deflector ring rotates at the same speed as the rotating deflector.

2. The rotating deflector of claim 1, wherein the deflector ring is provided at the outer edge of the rotating deflector.

3. The rotating deflector of claim 1, wherein the deflector ring further comprises at least one rib protruding downward from a bottom surface of the deflector ring and extending outward at an angle relative to a radius of the rotating deflector.

4. The rotating deflector of claim 3, wherein the at least one rib extends into an outlet of at least one channel of the plurality of channels formed on the bottom surface of the rotating deflector, such that water flowing through the at least one channel deflects off the rib to impart additional rotational force when the deflector ring is in the first position.

5. The rotating deflector of claim 4, wherein the at least one rib is positioned away from the outlet of the at least one channel of the plurality of channels when the ring is in the second position.

6. The rotating deflector of claim 2, wherein the deflector ring further comprises a plurality of ribs, each rib of the plurality of ribs protruding downward from a bottom surface of the deflector ring and extending outward at an angle relative to a radius of the rotating deflector.

7. The rotating deflector of claim 6, wherein each rib extends into an outlet of one channel of the plurality of channels formed on the bottom surface of the rotating deflector, such that water flowing through the channel deflects off the rib and imparts additional rotational force when the deflector ring is in the first position.

8. The rotating deflector of claim 7, wherein each rib is moved away from the outlet of any channel of the plurality of channels when the deflector ring is in the second position.

9. A rotating water deflecting element for use in a rotary sprinkler comprises:

a body;

a plurality of channels formed on a bottom surface of the body at least at an outer edge of the body; and a ring rotatably mounted on the body such that a rotational position of the ring with respect to the body is manually settable to provide a desired rotation speed of the rotating water deflecting element between a first position in which the ring provides additional rotational force for rotation of the rotating water deflecting element and a second position in which the ring provides substantially no additional rotational force for rotation of the rotating water deflecting element, the ring mounted on the body such that the ring rotates at the same speed as the body.

10. The rotating water deflecting element of claim 9, wherein the ring is provided at the outer edge of the body.

11. The rotating water deflecting element of claim 9, wherein the ring further comprises at least one rib protruding downward from a bottom surface of the ring and extending outward at an angle relative to a radius of the body.

12. The rotating water deflecting element of claim 11, wherein the at least one rib extends into an outlet of at least one channel of the plurality of channels formed on the bottom surface of the body, such that water flowing through the at least one channel deflects off the rib to impart additional rotational force when the ring is in the first position.

13. The rotating water deflecting element of claim 12, wherein the at least one rib is positioned away from the outlet of the at least one channel of the plurality of channels when the ring is in the second position.

14. The rotating water deflecting element of claim 10, wherein the ring further comprises a plurality of ribs, each rib of the plurality of ribs protruding downward from a bottom surface of the ring and extending outward at an angle relative to a radius of the conical body.

15. The rotating water deflecting element of claim 14, wherein each rib extends into an outlet of one channel of the plurality of channels formed on the bottom surface of the body, such that water flowing through the channel deflects off the rib and imparts additional rotational force when the ring is in the first position.

16. The rotating water deflecting element of claim 15, wherein each rib is moved away from the outlet of any channel of the plurality of channels when the ring is in the second position.

* * * * *